US007889221B2

(12) United States Patent
Koga

(10) Patent No.: US 7,889,221 B2
(45) Date of Patent: Feb. 15, 2011

(54) OPTICAL SCANNING APPARATUS

(75) Inventor: Katsuhide Koga, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 958 days.

(21) Appl. No.: 11/743,593

(22) Filed: May 2, 2007

(65) Prior Publication Data

US 2007/0286624 A1 Dec. 13, 2007

(30) Foreign Application Priority Data

Jun. 9, 2006 (JP) ..... 2006-161039

(51) Int. Cl.
*B41J 2/47* (2006.01)
*B41J 2/435* (2006.01)

(52) U.S. Cl. ..... 347/235; 347/234; 347/225; 347/229; 347/250

(58) Field of Classification Search ..... 347/235, 347/225, 229, 234, 250
See application file for complete search history.

(56) References Cited

U.S. PATENT DOCUMENTS

2004/0036936 A1* 2/2004 Nakajima et al. ..... 359/204

FOREIGN PATENT DOCUMENTS

| | | | |
|---|---|---|---|
| JP | 8-156332 A | | 6/1996 |
| JP | 2002-122799 A | | 4/2002 |
| JP | 2002-277776 A | | 9/2002 |
| JP | 2002277776 A | * | 9/2002 |

* cited by examiner

*Primary Examiner*—Julian D Huffman
*Assistant Examiner*—Sarah Al-Hashimi
(74) *Attorney, Agent, or Firm*—Canon U.S.A., Inc. I.P. Division

(57) ABSTRACT

An optical scanning apparatus forms a latent image by scanning a laser beam emitted from a light source on an image bearing member. The apparatus includes first and second laser beam detectors for detecting the laser beam and a scanning-line slope detector for detecting a slope of a scanning line on the image bearing member on the basis of the result of detection obtained by the first and second laser beam detectors. The first laser beam detector detects the laser beam in a scanning area in front of an area in which the latent image is formed on the image bearing member and the second laser beam detector detects the laser beam in a scanning area behind the area in which the latent image is formed on the image bearing member.

4 Claims, 6 Drawing Sheets

OPTICAL SCANNING APPARATUS

BACKGROUND OF THE INVENTION

1. Field of the Invention

The present invention relates to a technique for detecting optical characteristics of an image forming apparatus using an electrostatic or electrophotographic recording method.

2. Description of the Related Art

In general, an electrophotographic image forming apparatus includes an optical scanning apparatus that drives a semiconductor laser in accordance with input image data to form an electrostatic latent image corresponding to the image data on a photosensitive member.

The semiconductor laser used as a light source of the optical scanning apparatus emits a laser beam having a wavelength-temperature characteristic. In other words, when the temperature varies, the wavelength of the laser beam also varies. Accordingly, refractive and reflective indices of lenses for passing the laser beam therethrough and mirrors for reflecting the laser beam in the optical scanning apparatus vary. As a result, the magnification of scanning lines formed on the photosensitive member by the laser beam also vary.

When a multibeam light source is used, the above-described variation in magnification caused by the temperature characteristic is added to the initial differences in magnification due to differences in wavelength between the laser beams. As a result, magnifications of all of the laser beams vary individually. Accordingly, a method for detecting the magnification of each laser beam by forming test patterns on a photosensitive member and measuring gaps between the test patterns on an intermediate transferring member has been suggested (refer to, for example, Japanese Patent Laid-Open No. 8-156332).

However, the number of light sources may be increased to several tens or hundreds to achieve image forming apparatuses with higher speeds and resolutions. In such a case, it takes an extremely long time to form the test patterns and detect them. Therefore, the above-mentioned method is considered impractical.

The magnification of each beam is desired to be detected in the optical scanning apparatus instead of on the intermediate transferring member. Accordingly, a method for detecting the magnification by arranging sensors at upstream and downstream positions of the scanning lines and measuring the time required to scan between the two positions has been suggested (refer to, for example, Japanese Patent Laid-Open No. 2002-122799).

However, in the case in which, for example, a slope of the scanning lines caused by errors generated when the optical scanning apparatus is attached to the image forming apparatus is corrected in the optical scanning apparatus, accurate magnifications cannot be detected simply by measuring the time required to scan between the two position. The reasons for this will be explained below with reference to FIGS. 5, 6A-B, and 7A-B.

FIG. 5 is a schematic top view of the main part of an optical scanning apparatus. FIG. 5 shows scanning-position detection sensors 91 and 92, laser beams A and B emitted from a multibeam light source, a polygonal mirror 33, and an f-θ lens 34. FIG. 6A illustrates the relationship between the scanning-position detection sensors 91 and 92 and the laser beams A and B of the multibeam light source shown in FIG. 5 (case in which a slope θ is zero (0) in FIG. 7A).

FIG. 6B illustrates signals detected by the scanning-position detection sensors 91 and 92. FIG. 7A illustrates the relationship between the scanning-position detection sensors 91 and 92 and the laser beams A and B having a slope with an angle θ. FIG. 7B illustrates signals detected by the scanning-position detection sensors 91 and 92 when the scanning lines have a slope with the angle θ.

When the laser beams A and B have different wavelengths, the mirror 33 and the f-θ lens 34 have different reflective and refractive indices, respectively, for the laser beams A and B. Therefore, as shown in FIG. 5, the laser beams A and B have different scanning line widths (scanning magnifications). In the case shown in FIG. 5, the scanning speed of the laser beam B is higher than the scanning speed of the laser beam A. Therefore, in FIG. 6B, times Ta and Tb required for the laser beams A and B, respectively, to move between the scanning-position detection sensors 91 and 92 satisfy Ta>Tb.

When the distance between the scanning-position detection sensors 91 and 92 is L and the scanning speeds of the laser beams A and B are Va and Vb, respectively, the following equations are satisfied:

$$Va=L/Ta,\ Vb=L/Tb$$

When the scanning magnification of a scanning line A' of the laser beam A is defined as 1, the scanning magnification of the scanning line B' of the laser beam B is calculated as follows:

$$Vb/Va=Ta/Tb$$

However, if a slope of the scanning lines caused by errors generated when the optical scanning apparatus is attached to the image forming apparatus is corrected by adjusting lens positions and the like in the optical scanning apparatus, the scanning lines have a slope with an angle θ relative to the scanning-position detection sensors 91 and 92, as shown in FIG. 7A.

In FIG. 7A, the length of the scan lines is determined as L, although it is L'=L/cosθ in practice. The actual scanning speed of the laser beam A is calculated as follows:

$$Va'=L'/Ta=L/(Ta\cos\theta)$$

However, the scanning speed of the laser beam A is determined as follows:

$$Va'=L/Ta$$

This means that the determined scanning speed has an error by a factor of (1/cos θ−1). When the scanning speed of the laser beam A is used as a reference, the scanning magnification of the scanning line B' is determined using the following equation:

$$Vb'/Va'=Ta/Tb$$

Therefore, although relative magnifications can be calculated, magnifications of all of the laser beams include errors because the magnification of the scanning line A' used as a reference includes an error.

SUMMARY OF THE INVENTION

The present invention is directed to an optical scanning apparatus that can simultaneously detect slopes of scanning lines and laser magnifications of a multibeam optical system capable of emitting several tens or hundreds of beams to increase both speed and resolution, and that can perform the detection even during an image forming operation.

According to a first aspect of the present invention, an optical scanning apparatus forms a latent image by scanning a laser beam emitted from a light source on an image bearing member, the optical scanning apparatus including first and second laser beam detectors configured to detect the laser beam and a scanning-line slope detector configured to detect a slope of a scanning line on the image bearing member on the basis of the result of detection obtained by the first and second laser beam detectors.

According to a second aspect of the present invention, an optical scanning apparatus that forms a latent image on an image bearing member by deflecting and scanning a laser beam emitted from a light source in a main scanning direction using a deflecting scanning unit, the optical scanning apparatus including a first laser beam detector configured to detect the laser beam in a scanning area in front of an area in which the latent image is formed on the image bearing member; a second laser beam detector configured to detect the laser beam in a scanning area behind an area in which the latent image is formed on the image bearing member; and a scanning-line slope detector configured to detect a slope of a scanning line on the image bearing member with respect to the main-scanning direction on the basis of a time during which an output signal is output from the first laser-beam detector, a time during which an output signal is output from the second laser-beam detector, and a time from when the laser beam is incident on the first laser-beam detector to when the laser beam is incident on the second laser-beam detector.

According to a third aspect of the present invention, an optical scanning apparatus that forms a latent image on an image bearing member by deflecting and scanning a laser beam emitted from a light source in a main scanning direction using a deflecting scanning unit, the optical scanning apparatus including first and second laser beam detectors configured to detect the laser beam; and a scanning-line slope detector configured to detect a slope of a scanning line on the image bearing member on the basis of the result of detection obtained by the first and second laser beam. Each of the first and second laser beam detectors includes a first side at a front edge in the main-scanning direction and a second side at a rear edge in the main-scanning direction, the first and second sides not being parallel to each other. The first side of the first laser beam detector and the first side of the second laser beam detector are parallel to each other and the second side of the first laser beam detector and the second side of the second laser beam detector are parallel to each other.

Accordingly, the preset invention provides an optical scanning apparatus that can detect a slope of a scanning line and a scanning magnification of a laser beam and that can perform the detection even during an image forming operation.

Further features and aspects of the present invention will become apparent from the following description of exemplary embodiments with reference to the attached drawings.

DESCRIPTION OF THE EMBODIMENTS

An exemplary optical scanning apparatus according to an embodiment of the present invention will be described below with reference to the accompanying drawings.

[Exemplary Image Forming Apparatus]

Figure 1:
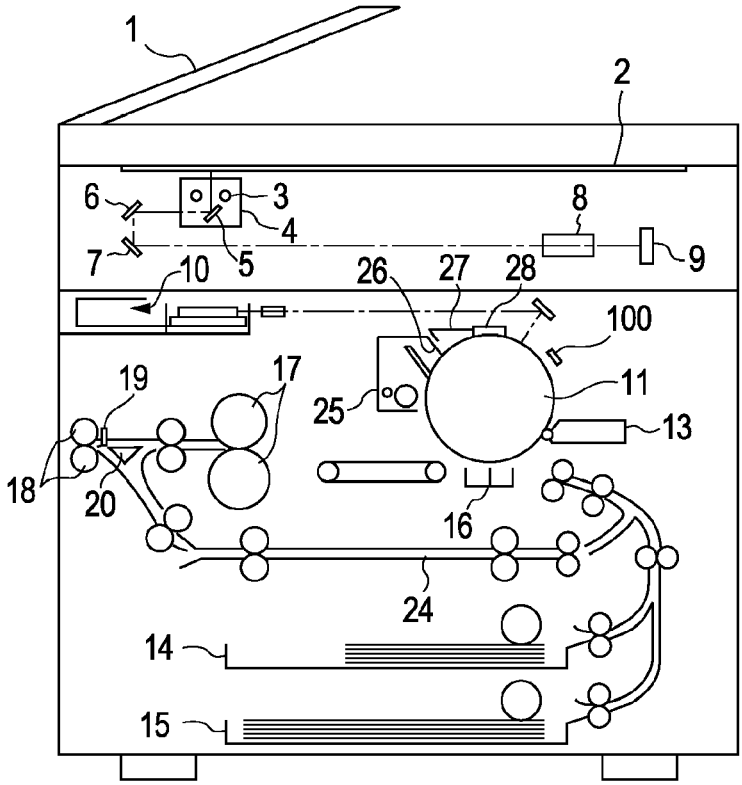
FIG. 1 is a sectional view illustrating the overall structure of an example image forming apparatus according to an embodiment of the present invention.

FIG. 1 is a sectional view illustrating the overall structure of an image forming apparatus according to the embodiment of the present invention. A basic operation of a digital copy machine will be described below with reference to FIG. 1.

The image forming apparatus includes an original feeder 1. The original feeder 1 successively conveys original sheets that are stacked thereon to an original plate glass 2 one at a time. When an original sheet reaches a predetermined position on the original plate glass 2, a lamp 3 on a scanner unit 4 is turned on and the scanner unit 4 starts moving while illuminating the surface of the original sheet. The illuminating light is reflected by the original sheet, is guided to a lens 8 through mirrors 5, 6, and 7, and forms an optical image on an imaging plane of an image sensor unit 9. The image sensor unit 9 converts the optical image into an electric signal by photoelectric conversion, which is input to an image processing unit (not shown). The image processing unit converts the input electric signal into a digital signal, and performs image processing of the thus-obtained digital signal to generate an image signal. The image signal is input to an exposure control unit (optical scanning apparatus) 10 directly or after being temporarily stored in an image memory.

The above-described exposure control unit 10 drives a semiconductor laser (not shown) in accordance with the received image signal, so that a laser beam is emitted from the semiconductor laser. The thus-emitted laser beam is directed to a rotatable photosensitive drum 11, which corresponds to an image bearing member, while being scanned in a main-scanning direction by a scanning system including a polygonal mirror. Accordingly, an electrostatic latent image corresponding to the image signal is formed on the photosensitive drum 11 which functions as a photosensitive member.

An auxiliary charger 26, a pre-exposure lamp 27, a primary charger 28, an electric potential sensor 100, a developer 13, a transfer device 16, and a cleaner 25 are arranged around the photosensitive drum 11. The auxiliary charger 26 removes electricity from the surface of the photosensitive drum 11. The pre-exposure lamp 27 removes residual electric charge from the surface of the photosensitive drum 11. The primary charger 28 uniformly charges the surface of the photosensitive drum 11. The electric potential sensor 100 functions as a sensor for measuring an electric potential on the surface of the photosensitive drum 11. Thus, the electric potential of the photosensitive drum 11 is measured by the electric potential sensor 100. The electric potential sensor 100 includes, for example, six sensor elements arranged with constant intervals in the main-scanning direction. The developer 13 supplies toner to the photosensitive drum 11 to visualize the electrostatic latent image on the photosensitive drum 11 as a toner image. The transfer device 16 transfers the toner image formed on the photosensitive drum 11 onto a sheet supplied from either of cassettes 14 and 15. The cleaner 25 scrapes and collects the toner remaining on the photosensitive drum 11 to allow the photosensitive drum 11 to prepare for the next image-forming cycle.

The sheet on which the toner image is transferred by the transfer device 16 is conveyed to a fixing device 17. The fixing device 17 applies heat and pressure to the toner image on the sheet, and thereby fixes the image on the sheet. The sheet on which the toner image is fixed is guided to discharge rollers 18 by a flapper 20, and is discharged out of the apparatus. In the case in which images are formed on both sides of the sheet, the trailing end of the sheet is detected by a sensor 19 after an image is formed on one side of the sheet, and then a sheet-inverting operation is performed by the flapper 20 to switch an image-forming surface to the other side. Due to the sheet-inverting operation, the sheet is conveyed to a duplex recording path 24. Then, the sheet is conveyed from the duplex recording path 24 to a position between the photosensitive drum 11 and the transfer device 16 again, where a toner image is transferred onto the other side of the sheet.

[Exemplary Structure of Exposure Control Unit]

Figure 2:
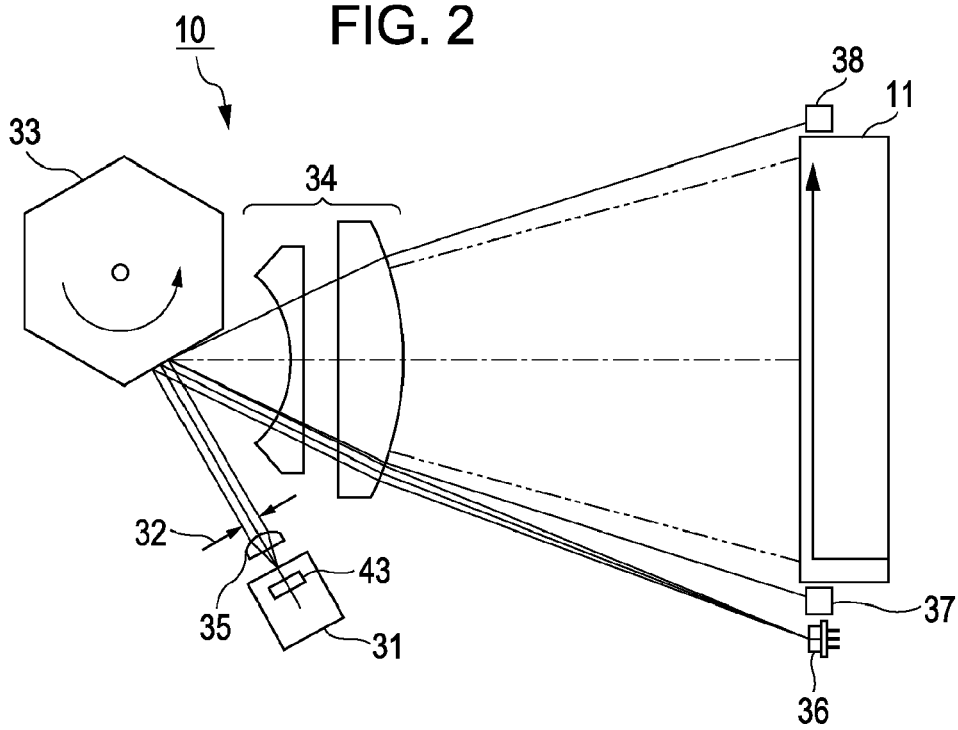
FIG. 2 is a schematic top view of an example exposure control unit according to the embodiment.

FIG. 2 is a schematic diagram illustrating the exemplary structure of the exposure control unit 10 according to the present embodiment. The exposure control unit 10 includes a semiconductor laser 43. A laser drive controller 31 drives and controls the semiconductor laser 43 to generate laser oscillation. A photodetector for detecting a part of the laser beam is disposed in the semiconductor laser 43. A detection signal obtained by the photodetector is used in automatic power control (APC) for controlling the intensity the laser beam emitted from the semiconductor laser 43 at a predetermined value.

The laser beam emitted from the semiconductor laser 43 is converted into a substantially collimated light beam with a predetermined beam diameter by a collimator lens 35 and an aperture 32, and is incident on a rotatable polygonal mirror 33, which corresponds to a deflecting scanning unit. The rotatable polygonal mirror 33 is rotated at a constant angular velocity in the direction shown by the arrow. This rotation of the rotatable polygonal mirror 33 converts the laser beam incident thereon into a beam deflected at a continuously changing angle. The deflected beam is condensed by the f-θ lens 34. At the same time, the f-θ lens 34 corrects distortion to ensure the temporal linearity of the scanning operation of the laser beam. Thus, a deflecting scanning operation is performed in which the photosensitive drum 11 is scanned by the laser beam at a constant speed.

A beam detect sensor (hereafter called a BD sensor) 36 is provided for detecting the laser beam that is reflected by the polygonal mirror 33 and passes through the f-θ lens 34. A detection signal obtained by the BD sensor 36 is used as a synchronizing signal for synchronizing the rotation of the rotatable polygonal mirror 33 with data write timing.

As scanning-position detection sensors, which correspond to laser-beam detectors, first and second scanning-position detection sensors (first and second laser-beam detectors) 37 and 38 are provided at upstream and downstream positions, respectively. The upstream position corresponds to a scanning area in front of an area in which a latent image is formed on the image bearing member, and the downstream position corresponds to a scanning area behind the area in which the latent image is formed on the image bearing member.

Thus, the laser beam emitted from the semiconductor laser 43 is converted into a substantially collimated light beam with a predetermined beam diameter by the collimator lens 35 and the aperture 32, and is then input to the rotatable polygonal mirror 33.

[Exemplary Structure of Scanning-Position Detection Sensors]

Figures 3A, 3B:
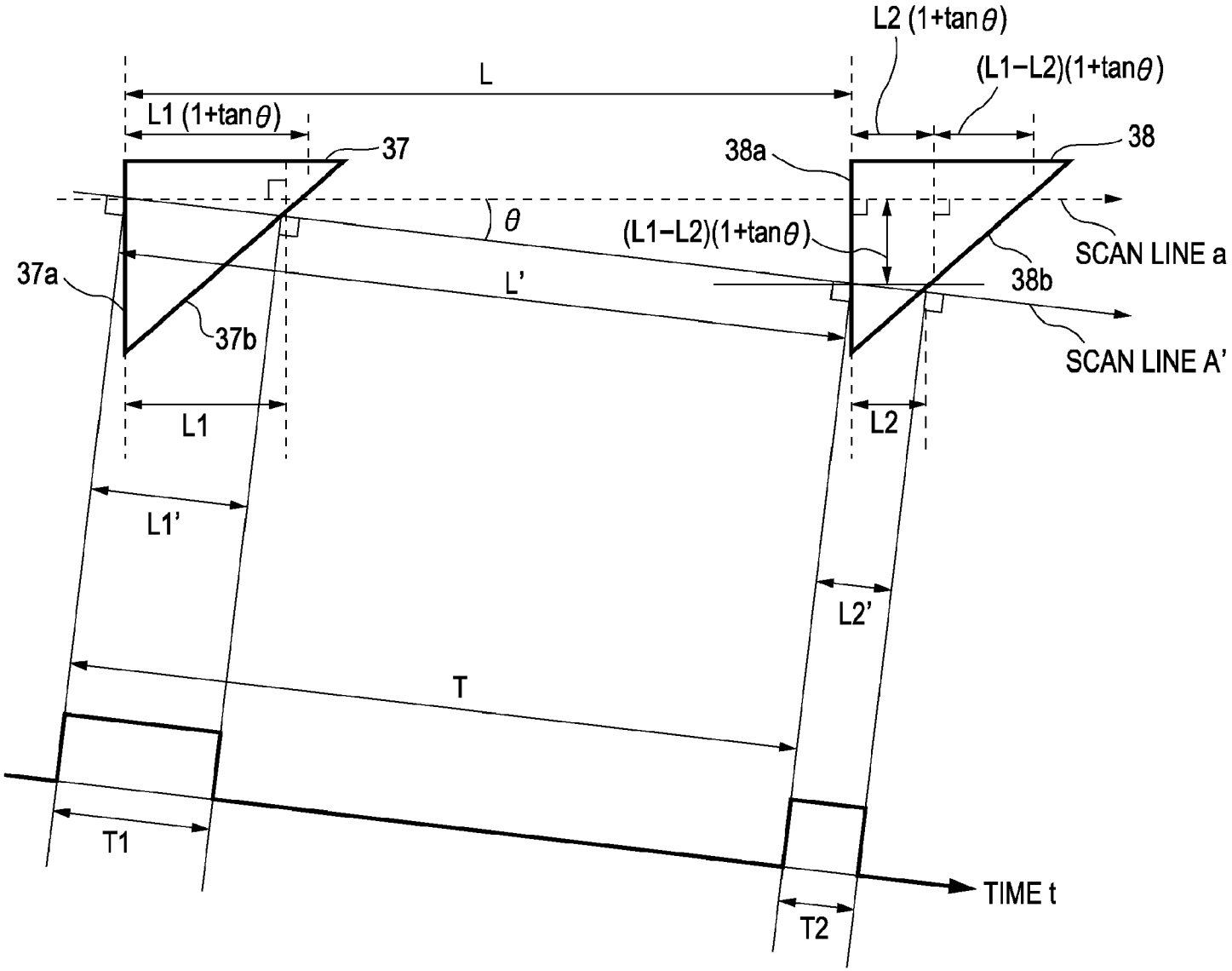
FIG. 3A is a diagram illustrating exemplary scanning-position detection sensors, a scanning line having a slope, and a scanning line without a slope.
FIG. 3B is a diagram illustrating the relationship between times during which output signals are output from the scanning-position detection sensors and a time from when a laser beam is incident on the upstream scanning-position detection sensor to when the laser beam is incident on the downstream scanning-position detection sensor.

FIG. 3A is a diagram illustrating an example of the structure of the scanning-position detection sensor 37 and 38 according to the present embodiment. FIG. 3A shows a scanning line A' (solid line) having a slope θ, which corresponds to a slope of the scanning line on the image bearing member, and an imaginary (ideal) scanning line a (dashed line) having no slope (θ=0).

FIG. 3B shows the relationship between times T1 and T2 (corresponding to pulse widths (lengths)) of output signals (corresponding to pulses) obtained by the scanning-position detection sensors 37 and 38, respectively, as a detection result, and a time T (corresponding to an interval between rising edges) from when the laser beam is incident on the scanning-position detection sensor 37 to when the laser beam is incident on the scanning-position detection sensor 38. L1', L2', and L' respectively denote the distance over which the actual scanning line A' passes through the first scanning-position detection sensor 37, the distance over which the actual scanning line A' passes through the second scanning-position detection sensor 38, and the distance from the position at which the actual scanning line A' reaches the first scanning-position detection sensor 37 to the position at which the actual scanning line A' reaches the second scanning-position detection sensor 38. In addition, L1, L2, and L denote distances obtained when the distances L1', L2', and L' are projected onto the imaginary scanning line a.

As shown in FIG. 3A, each of the scanning-position detection sensors 37 and 38 has a shape of an isosceles right-angled triangle. A first side 37*a* of the first scanning-position detection sensor 37 and a first side 38*a* (corresponding to a front edge in the main-scanning direction) of the second scanning-position detection sensor 38 are positioned parallel to each other. Similarly, a second side 37*b* of the first scanning-position detection sensor 37 and a second side 38*b* (corresponding to a rear edge in the main-scanning direction) of the second scanning-position detection sensor 38 are also positioned parallel to each other. In addition, the first and second scanning-position detection sensors 37 and 38 are positioned such that the first sides 37*a* and 38*a* thereof are perpendicular to the main-scanning direction (longitudinal or axial direction of the photosensitive drum).

In the present embodiment, the scanning-position detection sensors 37 and 38 having a shape of an isosceles right-angled triangle are used to facilitate the calculation. However, the shape of the scanning-position detection sensors is not limited to this, and may also be, for example, a simple right-angled triangle.

The first and second scanning-position detection sensors include a pair of parallel light-receiving elements. The first scanning-position detection sensor 37 includes the side 37*a* whose edges are perpendicular to the main-scanning direction and the second side 37*b* whose edges are not parallel to the main-scanning direction (at an angle θ). In addition, the second scanning-position detection sensor 38 includes the side 38*a* whose edges are perpendicular to the main-scanning direction and the side 38*b* whose edges are not parallel to the main-scanning direction (at an angle θ).

In FIG. 3A, the following equation is satisfied:

$$\tan\theta=(L1-L2)(1+\tan\theta)/L$$

Therefore, the following equation can be derived:

$$\tan\theta=(L1-L2)/(L1+L2)$$

By substituting L1=L1' cos θ, L2=L2' cos θ, and L=L' cos θ, the following equation is obtained:

$$\tan\theta=(L1'-L2')/(L'-L1'+L2')$$

Because T1 ∝ L1', T2 ∝ L2', and T ∝ L', the above equation can be rewritten as follows:

$$\tan\theta=(T1-T2)/(T-T1+T2)$$

where T1−T2 corresponds to a difference in pulse width. Accordingly, the slope angle θ can be calculated from the detected times T1, T2, and T.

In addition, because V'=L'/T and L'=L/cos θ, the scanning speed V' is calculated as follows:

$$V'=L/(T\cos\theta)$$

If the time required to scan the distance L along the imaginary scanning line a having no slope is t, the scanning speed v of the scanning line a is obtained as v=L/t. Therefore, the magnification (corresponding to scanning magnification) of the scanning line A' having the slope angle θ is calculated as follows:

$$V'/v=t/(T\cos\theta)$$

Because t is a designed value, the magnification of the scanning line A' can be calculated on the basis of two parameters: the above-described slope angle θ and the time T from when the laser beam is incident on the scanning-position detection sensor 37 to when the laser beam is incident on the scanning-position detection sensor 38.

[Exemplary Structure of Scanning-Position Detection Sensors]

Figure 4:
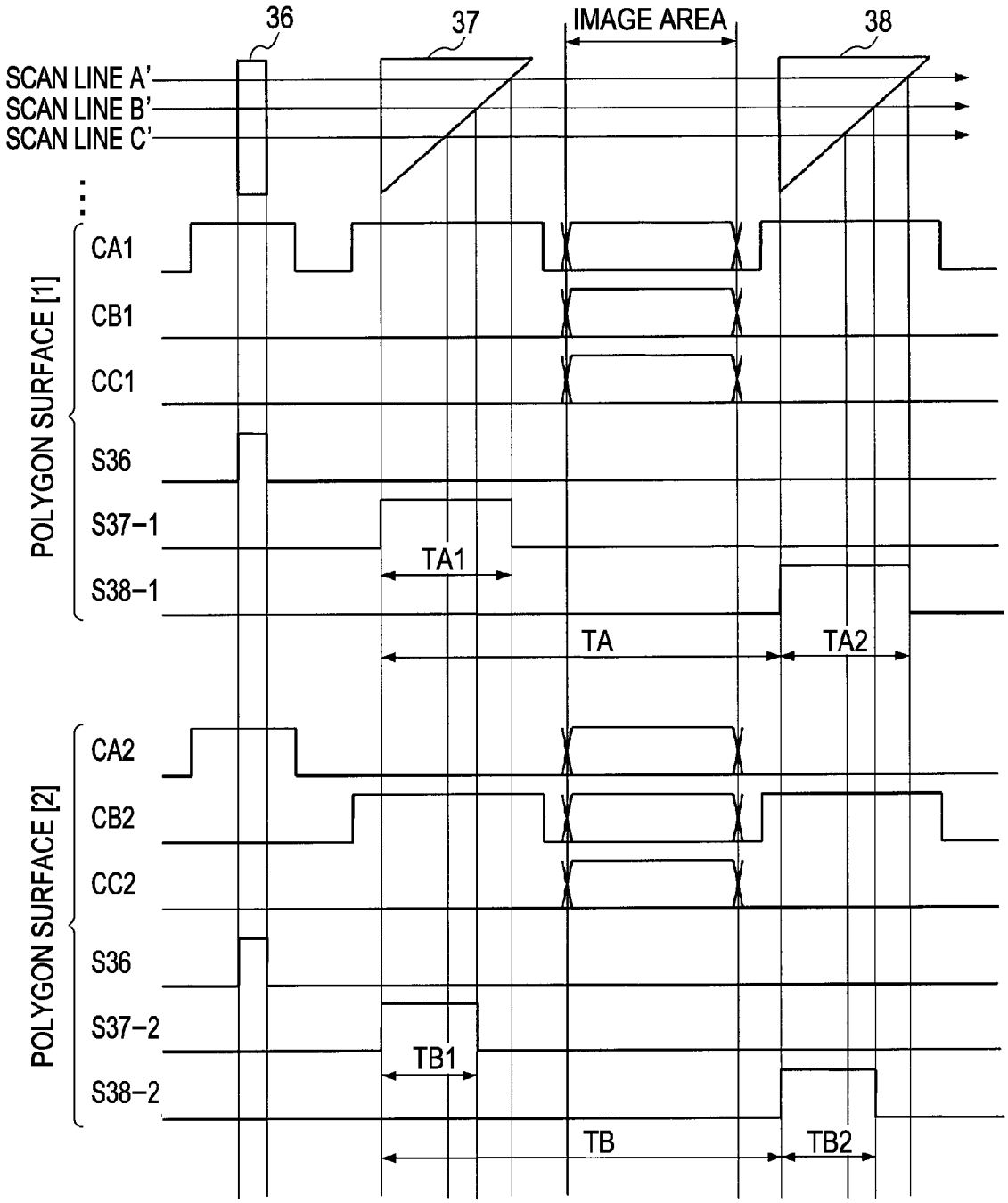
FIG. 4 is a diagram illustrating an example sequence of control signals according to the embodiment.
Figure 5:
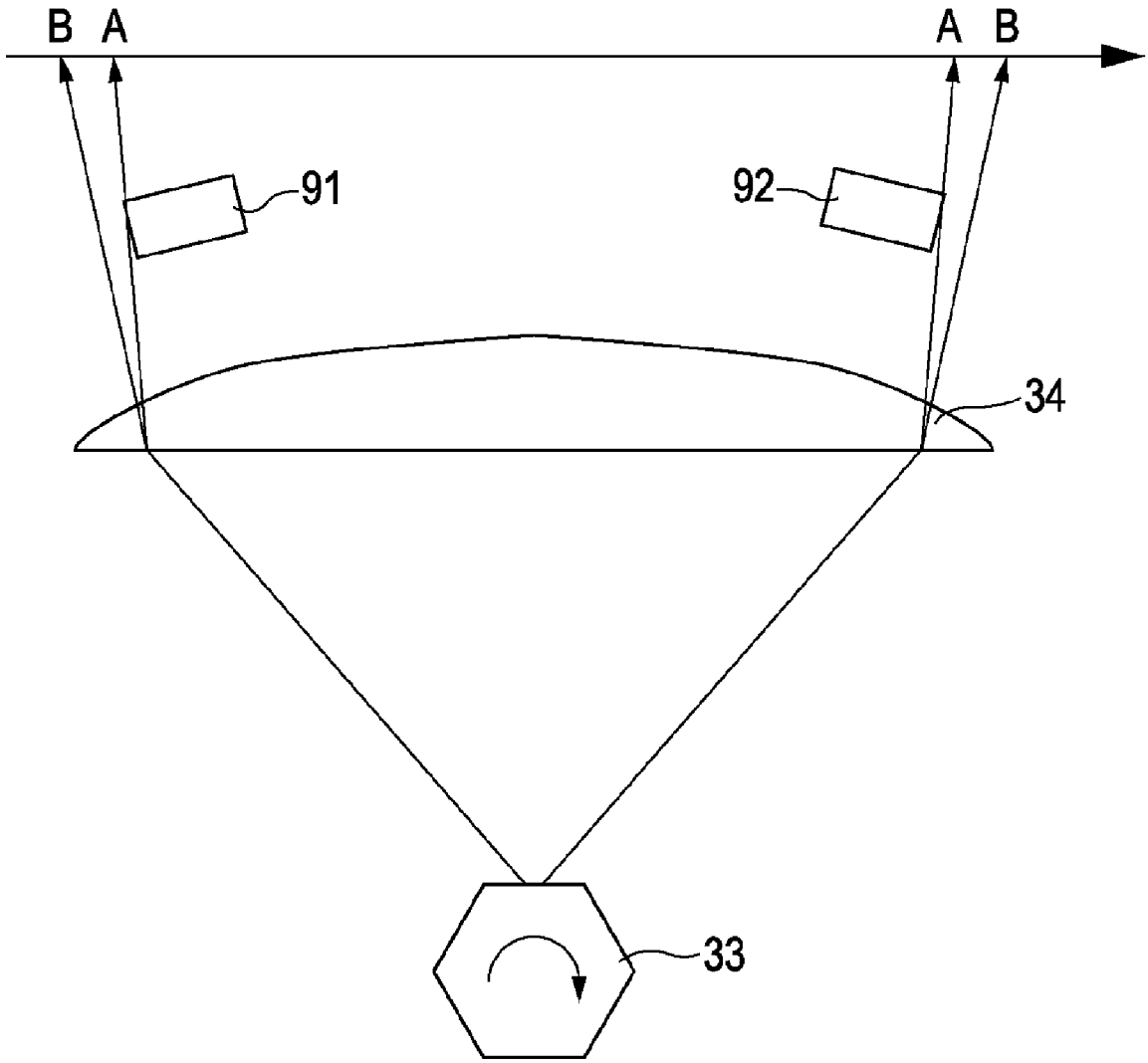
FIG. 5 PRIOR ART
FIG. 5 is a schematic top view of the main part of a known optical scanning apparatus.
Figures 6A, 6B:
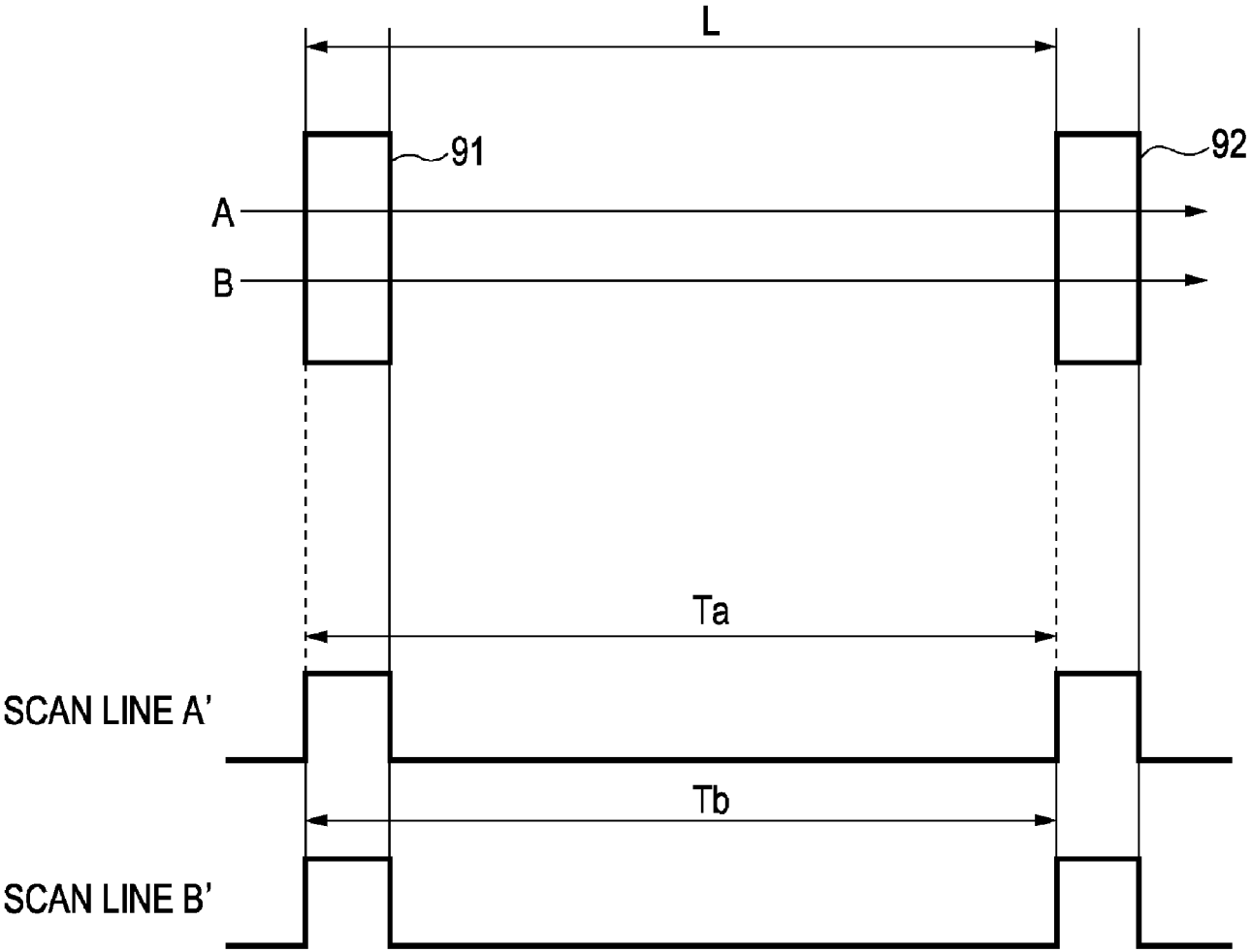
FIG. 6A PRIOR ART
FIG. 6B PRIOR ART
FIG. 6A is a diagram illustrating scanning-position detection sensors and laser beams in the known apparatus.
FIG. 6B is a diagram illustrating signals detected by the scanning-position detection sensors in the known apparatus.
Figures 7A, 7B:
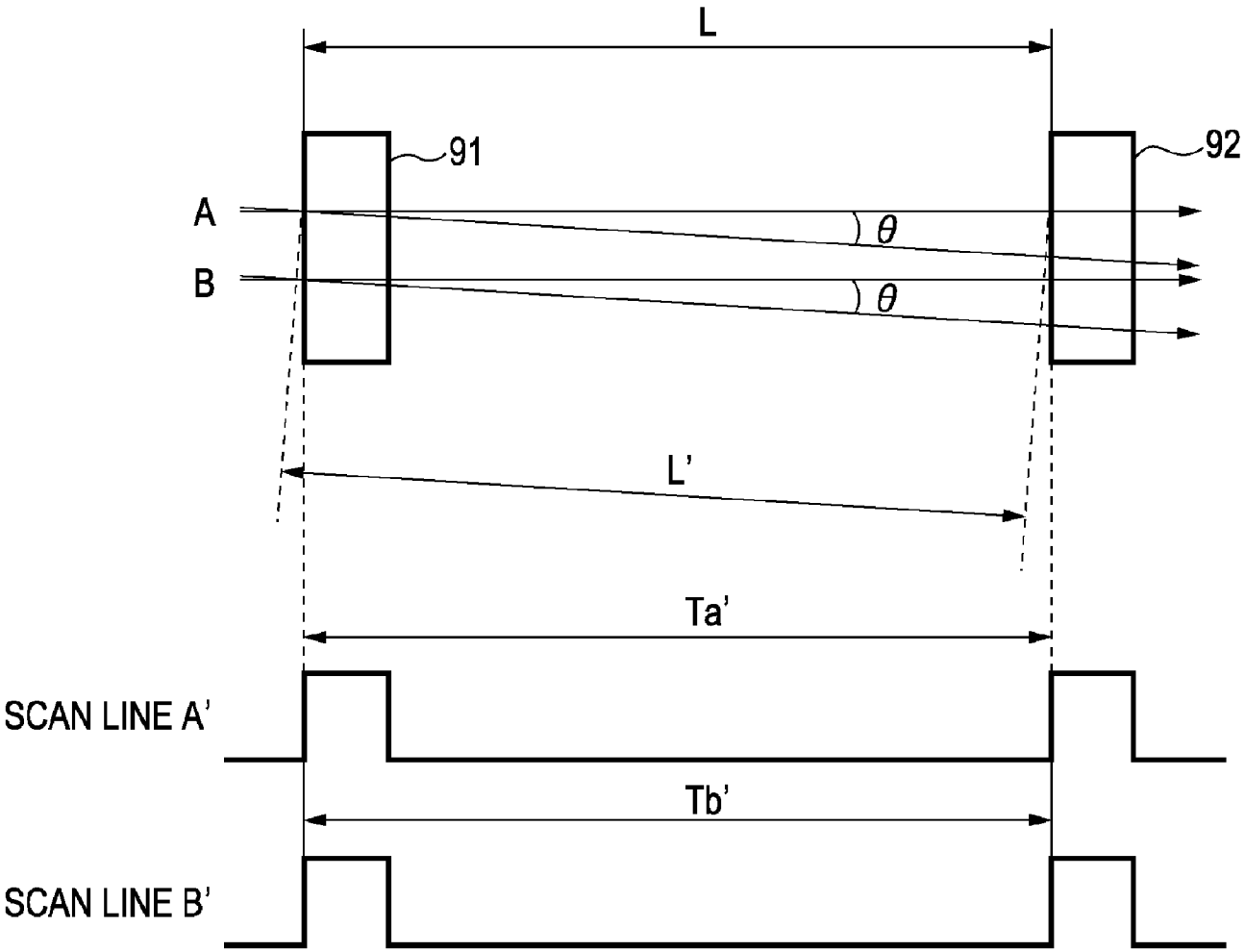
FIG. 7A PRIOR ART
FIG. 7B PRIOR ART
FIG. 7A is a diagram illustrating the scanning-position detection sensors and laser beams having a slope with an angle θ in the known apparatus.
FIG. 7B is a diagram illustrating signals detected by the scanning-position detection sensors when the scanning lines have a slope.

FIG. 4 illustrates an example of a method for detecting a scanning-position variation based on variation in the main-scan time caused by magnification errors. Scanning lines A', B', C', . . . , are shown as scanning lines formed by laser beams A, B, C, . . . , that can be simultaneously scanned by a single reflective surface of the rotatable polygonal mirror 33.

In FIG. 4, the laser beam A is always used for detecting the main-scanning synchronizing signal by scanning the BD sensor 36. Therefore, the control signal of the laser beam A is set such that the signal is turned on in front of the BD sensor 36 and is turned off after the detection (CA1 and CA2). The scanning-position detection sensors 37 and 38 are subjected to switch control so that only one of the laser beams is incident on the scanning-position detection sensors 37 and 38 in a single scan. Therefore, if, for example, the laser beam A is to be incident on the scanning-position detection sensors 37 and 38 for a certain reflective surface [1], the control signal for the laser beam A is set as denoted by CA1, while the control signals for the laser beams B and C are set as denoted by CB1 and CC1, respectively.

Each of the laser beams are ON/OFF controlled by the image modulation signals corresponding thereto in an image area. Accordingly, the output signals from the BD sensor 36, the upstream scanning-position detection sensor 37, and the downstream scanning-position detection sensor are obtained as denoted by S36, S37-1, and S38-1, respectively. The times TA1, TA2, and TA are determined from the signals S37-1 and S38-1, and the slope angle θ and the magnification of the laser beam A are calculated from the above-described equations.

When the reflective surface is switched to the next surface [2], the laser beam to be incident on the scanning-position detection sensors 37 and 38 is switched to the laser beam B. Accordingly, the control signals for the laser beams A, B, and C are set as denoted by CA2, CB2, and CC2! respectively. In this case, the output signal from the BD sensor 36 is obtained as denoted by S36, similar to the case in which the polygon surface [1] is set. In addition, the output signals from the upstream scanning-position detection sensor 37 and the downstream scanning-position detection sensor are obtained as denoted by S37-2 and S38-2, respectively. The times TB1, TB2, and TB are determined from the signals S37-2 and S38-2, and the magnification of the laser beam B is calculated on the basis of the above-described equation using the slope angle θ obtained in the case of the reflective surface [1]. Similarly, when the reflective surface is switched to the next surface, the laser beam to be incident on the scanning-position detection sensors 37 and 38 is switched to the laser beam C and the magnification of the laser beam C is calculated in a similar manner.

As described above, the laser incident on the scanning-position detection sensors 37 and 38 is switched each time the reflective surface used for scanning is changed. Then, the magnification of each laser is calculated by the above-described method on the basis of the output signals from the scanning-position detection sensors 37 and 38. Accordingly, the magnification of each laser can be detected even during the image forming process.

The measurement of the above-described times T1, T2, and T and calculation of the slope angle θ and magnification can be directly performed by a CPU (not shown). Alternatively, the CPU (not shown) can receive the results of measurement and calculation obtained by logic circuits using a high-speed clock.

In addition, according to the present embodiment, the laser incident on the scanning-position detection sensors 37 and 38 is changed for each reflective surface. However, the laser incident on the scanning-position detection sensors 37 and 38 can also be changed for each turn, or every several turns, of the rotatable polygonal mirror, and the magnification of each laser can be calculated on the basis of the average values of the detected times T1, T2, and T. When detection of each laser is always performed using a corresponding one of the reflective surfaces, the detection can be performed with high accuracy even if there are differences between the reflective surfaces.

As described above, according to the present embodiment, the accurate magnification can be detected even when the scanning line has a slope. In addition, even during the image forming process, the detection can be performed using signals obtained in a region outside the image area without reducing the productivity.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-161039 filed Jun. 9, 2006, which is hereby incorporated by reference herein in its entirety.

What is claimed is:

1. An optical scanning apparatus that forms a latent image by scanning a laser beam emitted from a light source on an image bearing member, the apparatus comprising:

first and second laser beam detectors configured to detect the laser beam; and a calculator configured to calculate a slope of a scanning line on the image bearing member on the basis of a result of detection obtained by the first and second laser beam detectors, wherein the first laser beam detector detects the laser beam in a scanning area in front of an area in which the latent image is formed on the image bearing member and the second laser beam detector detects the laser beam in a scanning area behind the area in which the latent image is formed on the image bearing member, wherein the slope θ of the scanning line on the image bearing member is calculated by the calculator as follows:

$$\tan\theta=(T1-T2)/(T-T1+T2)$$

where T is a time from when the laser beam is incident on the first laser-beam detector to when the laser beam is incident on the second laser-beam detector, T1 is a time during which an output signal is output from the first laser-beam detector, and T2 is a time during which an output signal is output from the second laser-beam detector.

2. The optical scanning apparatus according to claim 1, wherein a scanning magnification of the laser beam is calculated on the basis of the slope θ by the caculator, the time T, and a time t from when the laser beam is incident on the first laser-beam detector to when the laser beam is incident on the second laser-beam detector in the case in which the slope θ is 0.

3. An optical scanning apparatus that forms a latent image on an image bearing member by deflecting and scanning a laser beam emitted from a light source in a main scanning direction using a deflecting scanning unit, the optical scanning apparatus comprising:

a first laser beam detector configured to detect the laser beam in a scanning area in front of an area in which the latent image is formed on the image bearing member;

a second laser beam detector configured to detect the laser beam in a scanning area behind an area in which the latent image is formed on the image bearing member; and a calculator configured to calculate a slope of a scanning line on the image bearing member with respect to the main-scanning direction on the basis of a time during which an output signal is output from the first laser-beam detector, a time during which an output signal is output from the second laser-beam detector, and a time from when the laser beam is incident on the first laser-beam detector to when the laser beam is incident on the second laser-beam detector, wherein the slope θ of the scanning line on the image bearing member with respect to the main-scanning direction is calculated by the calculator as follows:

$$\tan\theta=(T1-T2)/(T-T1+T2)$$

where T is the time from when the laser beam is incident on the first laser-beam detector to when the laser beam is incident on the second laser-beam detector, T1 is the time during which the output signal is output from the first laser-beam detector, and T2 is the time during which the output signal is output from the second laser-beam detector.

4. The optical scanning apparatus according to claim 3, wherein a scanning magnification of the laser beam is calculated on the basis of the slope θ by the caculator, the time T, and a time t from when the laser beam is incident on the first laser-beam detector to when the laser beam is incident on the second laser-beam detector in the case in which the slope θ is 0.

* * * * *